US006073799A

United States Patent [19]

Yuyama et al.

[11] Patent Number: 6,073,799

[45] Date of Patent: Jun. 13, 2000

[54] TABLET FEEDER

[75] Inventors: Shoji Yuyama; Naoki Koike, both of Toyonaka, Japan

[73] Assignee: Kabushiki Kaisha Yuyama Seisakusho, Osaka, Japan

[21] Appl. No.: 09/208,418

[22] Filed: Dec. 10, 1998

Related U.S. Application Data

[63] Continuation of application No. 08/863,401, May 27, 1997, abandoned.

[30] Foreign Application Priority Data

May 31, 1996 [JP] Japan ..... 8-138207

[51] Int. Cl.[7] ..... B65E 59/00

[52] U.S. Cl. ..... 221/154; 221/258; 221/263; 221/287

[58] Field of Search ..... 221/151, 152, 221/154, 196, 197, 258, 263, 265, 287

[56] References Cited

U.S. PATENT DOCUMENTS 4,903,861 2/1990 Yuyama ..... 221/265

4,997,405 3/1991 Dabrowski ..... 221/265

5,794,816 8/1998 Pliler et al. ..... 221/265

FOREIGN PATENT DOCUMENTS 9-30501 2/1997 Japan .

*Primary Examiner*—H. Grant Skaggs

*Attorney, Agent, or Firm*—Wenderoth, Lind & Ponack, L.L.P.

[57] ABSTRACT

A tablet feeder includes a mechanism for preventing tablets from being discharged from any pocket formed in the outer periphery of a rotor mounted on a tablet storage case when the case is fitted on or removed from a support. The tablet feeder includes the tablet storage case and the support. The rotor is rotatably mounted on an inner bottom of the case. A plurality of pockets are formed in the outer periphery of the rotor at predetermined intervals. The rotor is rotated by a motor through a gear. A resilient engaging member having a toothed tip is mounted on the inner bottom of the case. The resilient engaging member carries a disengaging arm. When the case is dismounted from the support, the toothed tip engages a gear provided at the bottom end of the rotor, preventing the rotation of the rotor.

3 Claims, 4 Drawing Sheets

TABLET FEEDER

This is a continuation application of Ser. No. 08/863,401, filed May 27, 1997, now abandoned.

BACKGROUND OF THE INVENTION

This invention relates to a tablet feeder for feeding tablets (or capsules).

Tablet feeders are used to feed tablets to tablet packaging machines. There are many kinds of known tablet feeders. One conventional tablet feeder comprises a support and a tablet storage case which can be detachably mounted on the support from a horizontal direction. A rotor is mounted in the case and a motor for rotating the rotor is mounted in the support.

A discharge channel is formed in the support and a plurality of pockets are formed in the outer periphery of the rotor. When each pocket aligns with the discharge channel, a tablet in the pocket drops into the discharge channel and is discharged downward.

The case has an inner bottom formed with a conical recess in which is received a rotor having a diamondshaped vertical section so as to be rotatable about its rotary shaft. A driven gear is mounted to the bottom of the rotary shaft. A motor for rotating the rotor is mounted in the support. When the case is mounted on the support, a driving gear provided at the end of the output shaft of the motor engages the driven gear.

When each pocket formed in the outer periphery of the rotor aligns with the discharge channel, a tablet in the pocket drops into the discharge channel.

In order to replenish tablets while there still remain tablets in the case or when tablets have run out, the case has to be removed from the support. When the case is removed from the support, the driven gear and driving gear may move slightly relative to each other. This causes the rotor to rotate though slightly.

If the rotor rotates even slightly, a pocket just before the discharge point may move into alignment with the discharge channel, resulting in a tablet in this pocket being discharged unintentionally. Thus, an unfortunate patient is going to take one too many tablets. This problem is solvable if the feeder is provided with a means for preventing the rotation of the rotary shaft at the bottom of the rotor which is provided in the case when the case is removed from the support.

An object of the present invention is to provide a tablet feeder having such a rotation stop means.

SUMMARY OF THE INVENTION

According to this invention, there is provided a tablet feeder comprising a tablet storage case having an inner bottom, a rotor having a driving shaft and a driving gear at is bottom end thereof and rotatably mounted on the inner bottom, a motor for rotating the rotor, a support for supporting the motor, the case being detachably mounted on the support, the rotor having a plurality of pockets formed in its outer periphery at angular intervals, a discharge channel provided in such a position that the pockets come into alignment one after another with the discharge channel as the rotor rotates, whereby a tablet in each pocket is discharged into the discharge channel every time each pocket aligns with the discharge channel, and a rotation stop means provided on a lower bottom of the case for stopping the rotation of the rotor by engaging the driving gear provided on the rotary shaft provided at the bottom of the rotor when the case is removed from the support.

The rotation stop means comprises a resilient engaging member having at its tip a toothed portion adapted to engage the driving gear on the rotary shaft of the rotor, and a disengaging member connected to the resilient engaging member for pushing back the resilient member by abutting a portion of the support, thereby disengaging the toothed portion from the driving gear.

In the preferred form of the invention, the resilient member is an L-shaped member, and the disengaging member is an L-shaped projection provided near the tip of the resilient member.

In use, the tablet storage case is mounted on the case. A predetermined number of tablets are stored in the case. As the rotor is rotated, tablets are discharged one after another through the discharge channel. When the case is removed from the support for inspection of the feeder or in order to supply tablets while tablets are being discharged or when all the tablets have been discharged from the feeder, a pocket may stop at a position immediately before the discharge point. Since the gears for transmitting the torque of the motor to the rotor disengage from each other when the case is removed from the support, the gears may rotate relative to each other, causing the rotor to rotate slightly. If the rotor rotates even slightly in this state, the above pocket may move into alignment with the discharge channel, causing a tablet in this pocket to be unintentionally discharged.

But according to this invention, the rotation stop means provided on the lower bottom of the case prevents even the slightest rotation of the rotor when the case is removed from the support. Thus, it is possible to prevent a tablet from being unexpectedly discharged from a pocket.

Other features and objects of the present invention will become apparent from the following description made with reference to the accompanying drawings, in which:

DETAILED DESCRIPTION OF THE PREFERRED EMBODIMENT

Figure 1:
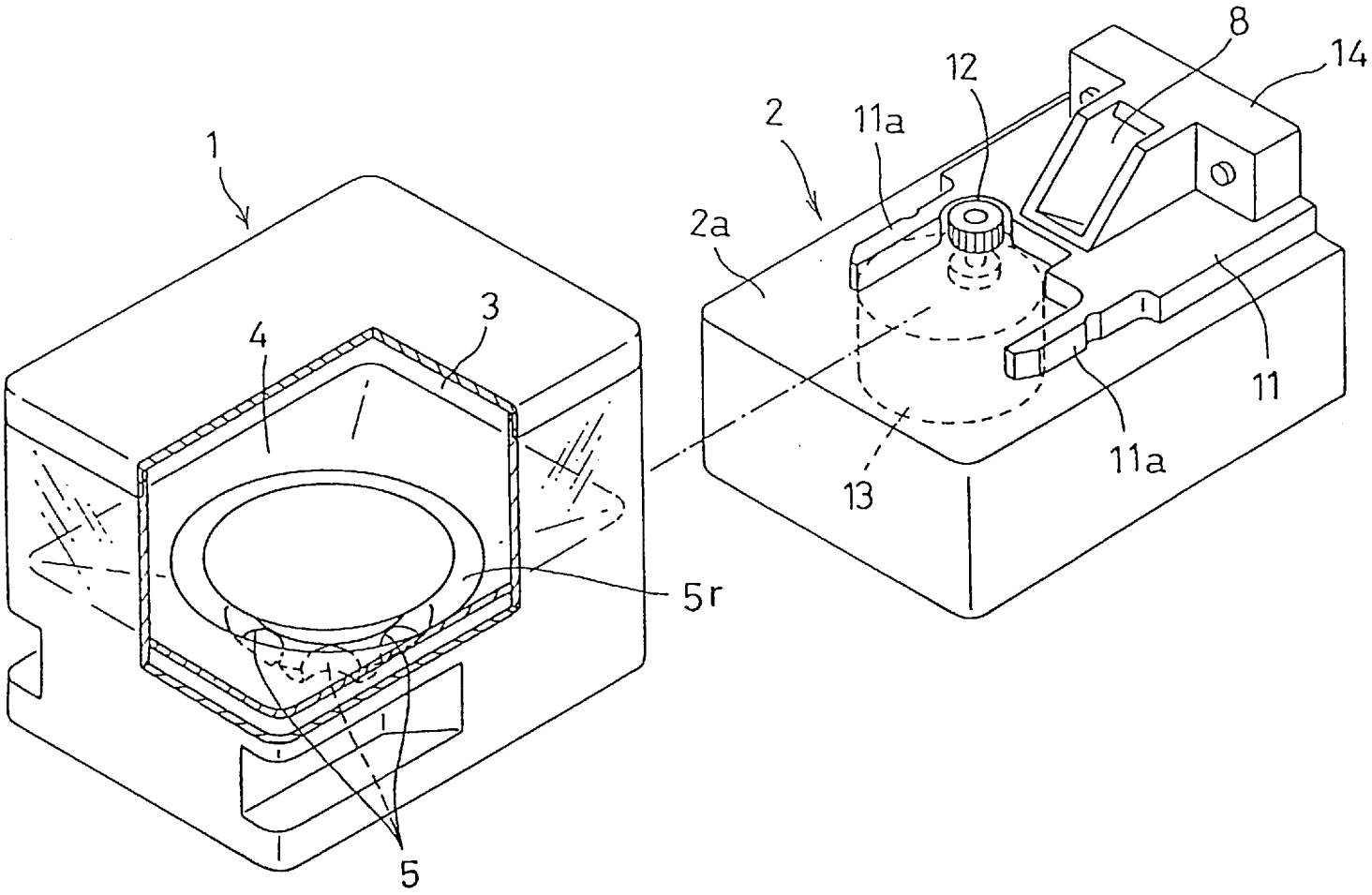
FIG. 1 is an exploded perspective view of a tablet feeder of an embodiment.

Now referring to the drawings, the embodiment of this invention is described.

FIG. 1 is an exploded perspective view of a tablet feeder embodying the present invention. Since the tablet feeder of this embodiment is basically of the same structure as conventional feeders, its description is limited to a minimum. As shown, the tablet feeder comprises a support 2 and a tablet storage case 1 detachable from the support 2.

Figure 3:
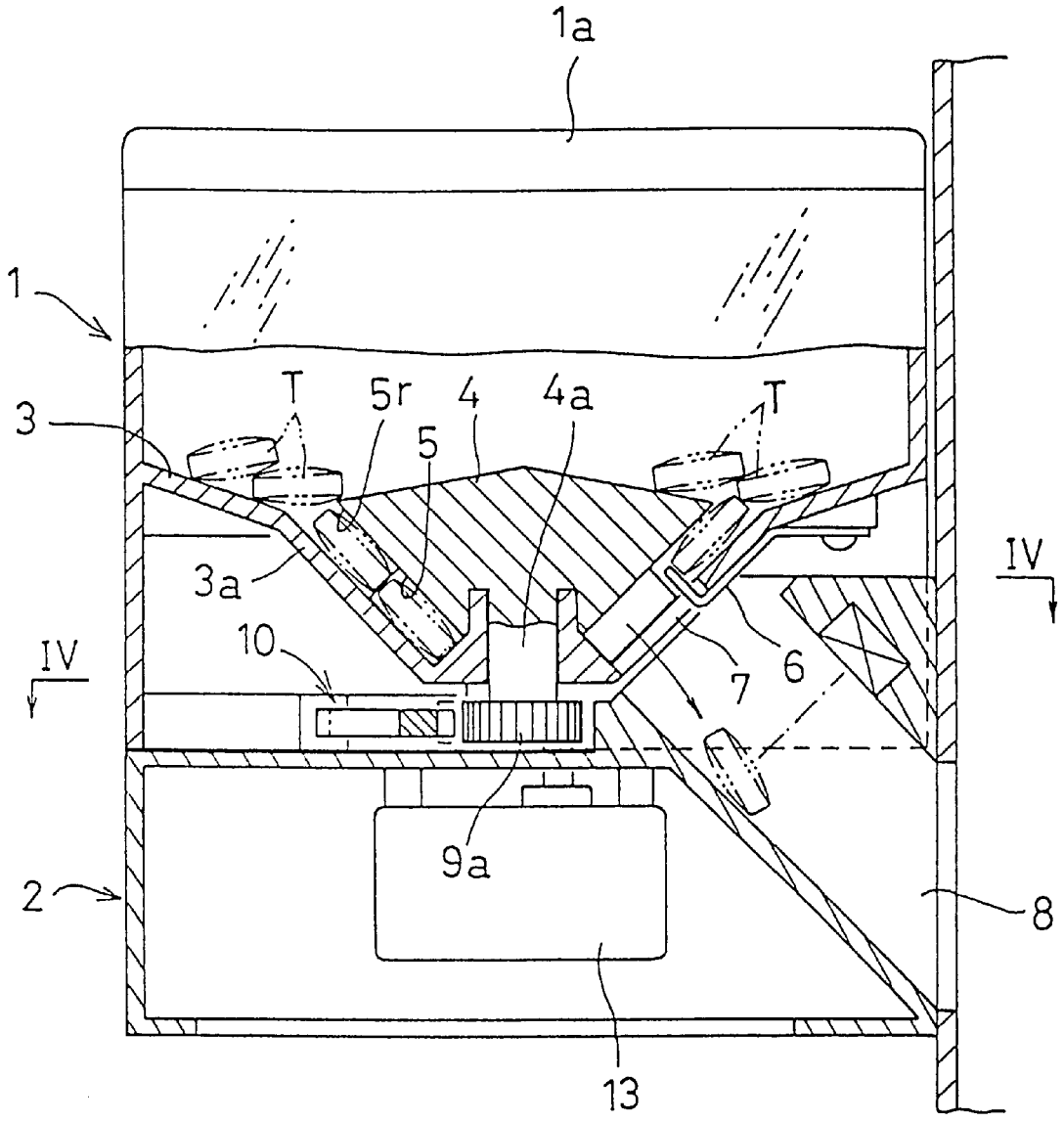
FIG. 3 is a partial sectional view of the tablet feeder.

The tablet storage case 1 has an inner bottom member 3 having a central conical recess 3*a* in which is received a rotor 4 rotatable about a rotary shaft 4*a* (FIG. 3). Formed in the outer periphery of the rotor 4 are a circular groove 5*r* into which tablets T drop, and a plurality of pockets 5 provided under the groove 5*r* at angular intervals. A shown in FIG. 3, a retainer plate 6 having an L-shaped tip is mounted on the back of the case bottom member, opposite to a discharge channel 8 formed in the support 2. Numeral 7 indicates an opening. Numeral la is a cover plate.

A rotary gear 9*a* is mounted on the bottom end of the rotary shaft 4*a* of the rotor 4. The gear 9*a* meshes with a gear

Figure 2A:
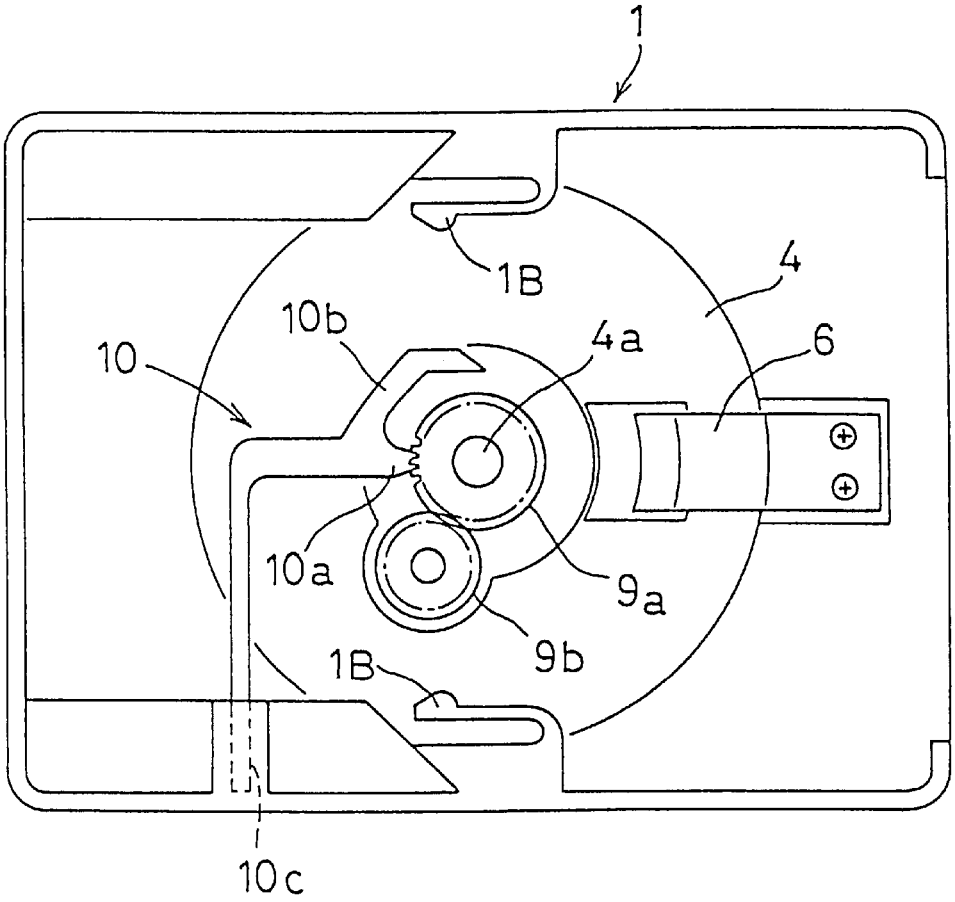
FIGS. 2A and 2B are bottom plan views of a case of the table feeder.
Figure 2B:
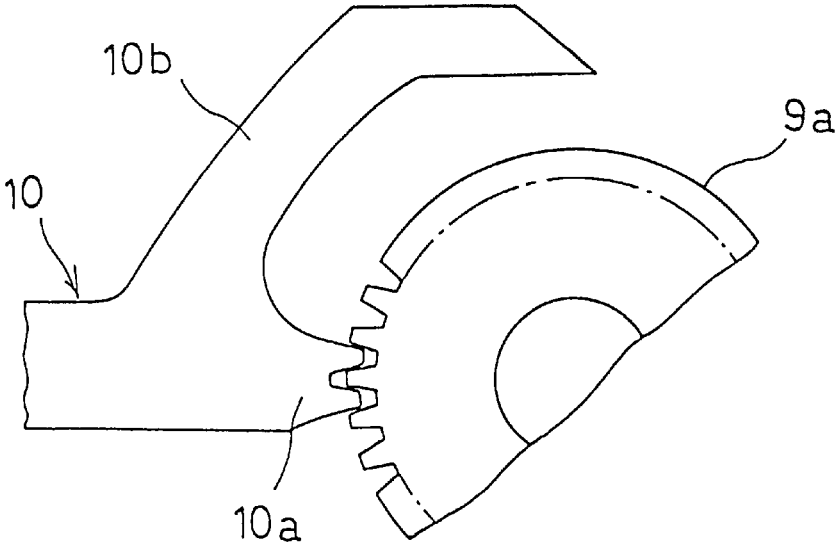

9*b* (FIG. 2A) mounted on the inner bottom plate 3 of the case. FIG. 2A is a bottom plan view of the bottom portion of the tablet storage case 1. Numeral 10 in this figure indicates an L-shaped resilient engaging member having a toothed portion 10*a* at its tip and fixed at its proximal end 10*c* to the lower bottom of the case 1. The resilient engaging member 10 has an L-shaped disengaging arm 10*b* near its tip. The arm 10*b* abuts a portion of the support 2 to disengage its toothed portion in the manner to be described hereinbelow.

Figure 4:
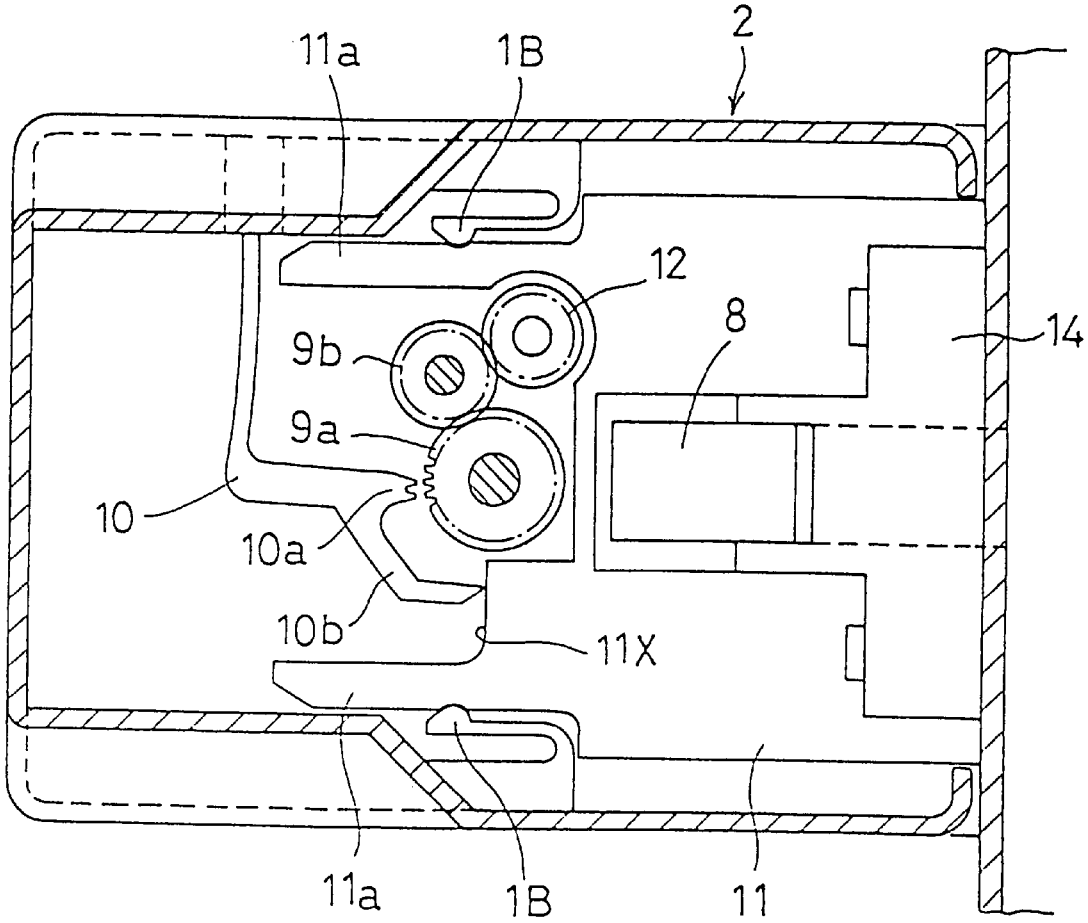
FIG. 4 is a sectional view taken along line IV-IV of FIG. 3.

A guide plate 11 is provided on the support 2 (FIG. 1). It has arms 11*a* at both ends for engaging the case 1. Each arm 11*a* is formed with a recess. The inner bottom of the case 1 has protrusions 1B adapted to fit in the recesses in the arms 11*a* from outside. When the protrusions 1B fit in the recesses in the arms 11*a*, the case 1 and the support 2 are coupled together. The guide plate 11 has a shoulder 11*x* opposite to the disengaging arm 10*b* (FIG. 4). When the case 1 is fitted, the shoulder 11*x* pushes back the arm 10*b*, disengaging the toothed portion 10*a* of the member 10 from the gear 9*a*.

A driving gear 12 is provided at one corner of the guide plate 11. It is driven by a motor 13 mounted in the support 2 through its rotary shaft. The rotor 4 is rotated when the rotary gear 9*b* of the case 1 fits in the support 2 and meshes with the gear 12. The discharge channel 8 and a sensor S for detecting the passage of tablets are provided in a mounting block 14 mounted on the guide plate 11.

The operation of this embodiment is now described. The rotor 4 is rotated with a required number of tablets stored in the case 1 and the cover plate la closed. Each time one of the pockets 5 aligns with the opening 7 and the discharge channel 8, the lower one of two tablets in this pocket drops into the discharge channel 8. As the rotor 4 further rotates and this pocket gets clear of the retaining plate 6, the upper tablet drops into the now empty lower space. When, thereafter, the pocket behind this one pocket (with respect to the direction of rotation of the rotor) aligns with the discharge channel 8, the lower one of the tablets in this pocket is discharged into the discharge channel. Tablets are thus discharged one after another into the discharge channel 8.

It may be necessary to remove the case 1 from the support 2 for inspection of the feeder or in order to supply tablets while tablets are being discharged or when all the tablets have been discharged from the feeder. (Before removing the case, the motor has to be stopped.)

By stopping the motor, the rotor is stopped. If, in this state, one of the pockets in which are received tablets is just short of the point where it aligns with the discharge channel 8, the tablets in this pocket are not discharged but remain in the pocket.

When the case 1 is removed from the support 2 in this state, the gear 12 on the output shaft of the motor disengages from the gear 9*b* at the bottom end of the rotor 4. As soon as the gear 12 disengages from the gear 9*b*, the disengaging arm 10*b*, which has been pushed by the shoulder 11*x* of the guide plate 11 and kept disengaged, returns to its original position, so that the toothed portion 10*a* at the tip of the resilient member 10 engages the gear 9*a* at the bottom end of the rotor 4, stopping the rotation of the rotor.

This prevents even slight rotation of the rotor 4 when the case 1 is removed from the support 2, so that any pocket of the rotor which is just short of the point where it aligns with the discharge channel 8 remains in this position, keeping the tablets inside from being discharged.

Since the resilient member 10 is biased in one direction while the case 1 is mounted on the support 2, it will move in the opposite direction when the case is removed from the support, so that its toothed portion 10 will move obliquely relative to the gear 9*a*, thus slightly rotating the gear 9*a*. The proximal end 10*c* of the resilient member 10 is provided on one side of the lower bottom of the case so that the gear 9*a* rotates, pushed by the toothed portion 10*a*, in the direction opposite to the direction in which the rotor 4 rotates to discharge tablets.

The disengaging arm 10*b* of the resilient member 10 pushes back the resilient member 10 in cooperation with the shoulder 11*x* of the guide plate 11. But if the arm 10*b* is sufficiently long, the shoulder 11*x* may be omitted because such a long arm can be brought into contact with any other part of the guide plate 11.

The resilient member 10 of the embodiment is an L-shaped member. But its shape is not limited provided its toothed portion 10*a* is adapted to engage the gear 9*a* when the case 1 is removed and disengage therefrom when the case is mounted on the support.

For example, the resilient member may comprise a straight rod mounted on a side wall of the case bottom member to extend along the line passing the center of the rotor 4 and extending in the direction in which the case is attached or detached, a head resiliently mounted on the rod through a spring provided in the head so as to be movable in parallel to the rod and provided with a toothed portion at its tip, and a disengaging arm extending from one side of the head. Otherwise, a brake for stopping the rotation of the rotary shaft 4*a* of the rotor may be mounted directly on the shaft 4*a* at the back of the inner bottom of the case opposite the recess 3*a*. The brake may be released when the case is mounted on the support and applied when the case is removed.

As described in detail, the tablet feeder of the invention has the resilient member mounted on the lower bottom of the case. When the case is removed from the support, the rotation stop means prevents the rotation of the rotor by engaging the gear of the rotor. This prevents the gear from disengaging and thus prevents the tablets in a pocket immediately before the discharge point from being discharged.

What is claimed is:

1. A tablet feeder comprising a tablet storage case having an inner bottom, a rotor having a driving shaft and a driving gear at a bottom end thereof and rotatably mounted on said inner bottom, a motor for rotating said rotor, a support for supporting said motor, said case being detachably mounted on said support, said rotor having a plurality of pockets formed in its outer periphery at angular intervals, a discharge channel provided in such a position that said pockets come into alignment one after another with said discharge channel as said rotor rotates, whereby a tablet in each pocket is discharged into said discharge channel every time said each pocket aligns with said discharge channel, and a rotation stop means provided on a lower bottom of said case for stopping the rotation of said rotor by engaging said driving gear provided on said rotary shaft provided at the bottom of said rotor when said case is removed from said support.

2. A tablet feeder as claimed in claim 1 wherein said rotation stop means comprises a resilient engaging member having at its tip a toothed portion adapted to engage said driving gear on said rotary shaft of said rotor, and a disengaging member connected to said resilient engaging member for pushing back said resilient member by abutting a portion of said support, thereby disengaging said toothed portion from said driving gear.

3. A tablet feeder as claimed in claim 2 wherein said resilient engaging member is an L-shaped member, and wherein said disengaging member is an L-shaped projection provided near the tip of said resilient engaging member.

* * * * *